US006868560B2

(12) United States Patent
Bostock

(10) Patent No.: US 6,868,560 B2
(45) Date of Patent: Mar. 22, 2005

(54) SAFETY HEADGEAR

(75) Inventor: Hayden Bostock, Yan Yean (AU)

(73) Assignee: Bostock Developments Pty Ltd, Melbourne (AU)

( * ) Notice: Subject to any disclaimer, the term of this patent is extended or adjusted under 35 U.S.C. 154(b) by 0 days.

(21) Appl. No.: 10/398,974

(22) PCT Filed: Oct. 11, 2001

(86) PCT No.: PCT/AU01/01285

§ 371 (c)(1),
(2), (4) Date: Apr. 10, 2003

(87) PCT Pub. No.: WO02/30226

PCT Pub. Date: Apr. 18, 2002

(65) Prior Publication Data

US 2004/0093660 A1 May 20, 2004

(30) Foreign Application Priority Data

Oct. 12, 2000 (AU) ..... PR 0712

(51) Int. Cl.[7] ..... A42B 3/00
(52) U.S. Cl. ..... 2/411; 2/416
(58) Field of Search ..... 2/411, 410, 425, 2/416, 417, 418, 420

(56) References Cited

U.S. PATENT DOCUMENTS

| | | | | | |
|---|---|---|---|---|---|
| 2,625,683 | A | * | 1/1953 | Roth et al. | 2/6.1 |
| 2,829,376 | A | * | 4/1958 | Ernest | 2/209.3 |
| 3,263,235 | A | * | 8/1966 | Young | 2/181 |
| 3,268,911 | A | * | 8/1966 | Cox | 2/416 |
| 3,273,162 | A | * | 9/1966 | Andrews, III | 2/410 |
| 3,280,402 | A | * | 10/1966 | Gerhard | 2/414 |
| 3,383,705 | A | * | 5/1968 | Raschke | 2/416 |
| 3,462,763 | A | * | 8/1969 | Schneider et al. | 2/413 |
| 3,758,889 | A | * | 9/1973 | Erb | 2/416 |
| 4,051,555 | A | | 10/1977 | Daly | |
| 4,101,983 | A | * | 7/1978 | Dera et al. | 2/412 |
| 4,407,021 | A | * | 10/1983 | Kralik et al. | 2/416 |
| 4,443,892 | A | * | 4/1984 | Burgin | 2/418 |
| 5,826,278 | A | * | 10/1998 | King | 2/175.4 |
| 5,887,289 | A | * | 3/1999 | Theoret | 2/425 |
| 5,996,125 | A | | 12/1999 | Garzone | |
| 6,604,246 | B1 | * | 8/2003 | Obreja | 2/411 |

FOREIGN PATENT DOCUMENTS

DE 19518961 11/1996

* cited by examiner

*Primary Examiner*—Rodney M. Lindsey
(74) *Attorney, Agent, or Firm*—Volpe and Koenig, P.C.

(57) ABSTRACT

The present specification protective headgear including a unitary shell (1) having a bell shape with a non-uniform thickness, the shell being of sufficient size to enclose at least an upper part of the wearer's skull, the shell having an upper crown portion (6) with a central crown area (2) and a surrounding outer crown area (3), the shell further including a depending circumferential wall which has an upper wall area (4) adjacent to the outer crown area (2) and a lower wall area (5), the lower wall area (5) having a wall thickness generally greater than the wall thickness of said upper wall area (4), and the central crown area (2) having a wall thickness generally greater than the wall thickness of said outer crown area (3), the headgear further including a support system (9) attached to the lower wall area(s) of the shell (1) in a manner whereby no less than 5 mm space is maintained between the wearer's skull and an inside surface of the shell (1).

22 Claims, 7 Drawing Sheets

SECTION A-A

SAFETY HEADGEAR

The present invention relates to headgear suitable for activities that require head protection. In particular the present invention relates to headgear for use during work or recreational activities.

The invention will be described with particular reference to headgear suitable for use during recreational activities such as horse riding, however the invention is not exclusively limited to this application and is suitable for protecting a wearer's head during a wide range of activities. For example, the headgear is also suitable for industrial activities such as construction work and mining and can be used by security guards and police for protection against assault.

In particular the headgear of the present invention can be included in a new hat during manufacture or incorporated into an existing hat.

Head protection during recreational and work related activities is sufficiently important that dedicated national headgear standards exist for construction, bicycle and equestrian helmets.

Horse riding is typical of a sport that leads to many thousands of accidents each year. For example, in the United States over 180,000 people were hospitalised in 1994 as a result of horse riding related accidents. A large proportion of the resulting injuries were head injuries, most of which could have been avoided by wearing a helmet.

Horse riders commonly wear headgear of one sort or another, either for protection or as a fashion item. Riders who wear headgear for protection usually choose helmets to avoid injuries caused by striking their head on the ground or an obstacle during a fall. However many riders wear headgear purely as a fashion item. The fashion icon of Western riding, particularly in North America and Australia, is the "cowboy" hat or Akubra. This type of hat provides protection from the sun, but does not provide any protection against injury due to a fall. In Western Europe, riders are more likely to wear a riding cap, which consists of a close fitting, hard, almost hemispherical shell covered with material such as velvet. Riding caps are traditional fashion items and the hard shell provides some head protection in the event of a fall.

The majority of protective headgear for recreational activities comprise helmets having a rigid hemispherical shell, lined with expanded polystyrene or the like, that fit closely around the wearer's head. Typically these helmets are very bulky, and as much as 3 or 4 centimetres thick due to the relatively large amount of polystyrene required to adequately protect the wearer's head.

Despite the desirability of head protection, the wearing of a certified headgear during activities such as horse riding or bicycle riding is not compulsory in most countries. Many riders ignore safety risks and do not wear headgear such as protective helmets because they are bulky, hot and unattractive. Even in industries where the wearing of a protective helmet is supposed to be compulsory, workers often discard their helmets because a bulky helmet can inhibit movement and heat generated can cause excessive sweating and headaches. These problems can lead to a wearer having an accident, thus defeating the purpose of wearing a protective helmet.

In the past, efforts have been made to overcome the problem of excess heat being generated and trapped inside headgear such as protective helmets. For example, U.S. Pat. No. 5,718,004 relates to a protective equestrian helmet incorporating a vent device in the crown to transmit cool air from outside into the protective helmet and to allow escape of heated air from inside the helmet. Furthermore, UK patent application no. 2,240,255 relates to a protective helmet comprising a shell supported against the user's head by a number of spaced resilient pads to reduce heat build up.

The aesthetic or fashion aspect of headgear should not be underestimated and protective helmets are often disregarded in favour of more attractive headgear. The appearance of a horse rider can be of paramount importance, such as in dressage events. For many stockmen, it would be unthinkable to wear a protective helmet instead of the traditional Akubra. Furthermore, unlike a helmet, an Akubra has a wide brim to provide protection from the sun and this is important both for recreational riders, and professional riders such as stockmen who spend their working days on horseback under the sun.

In order to overcome these problems, attempts have been made in the past to provide a combination of a broad brim hat with existing protective helmets certified to satisfactory safety standards. An example of this is provided in Australian patent application no. 12437/97 which relates to a protective cover (hat) within which can be located a helmet.

However as mentioned above, protective helmets commonly include a relatively large quantity of expanded polystyrene and are 3 or 4 cm thick. Most of the attempts to provide a combination of an attractive hat with a protective helmet have been too simplistic, with the appearance of the hat ruined by a helmet that either bulges above the brim or is visible below it. Furthermore, the large size of the helmet causes the crown of the hat to be grossly enlarged and out of proportion to the brim. Accordingly these types of helmets have failed to grasp a market share.

It has now been found that a headgear can be provided which provides improved head protection.

Accordingly, the present invention provides headgear for protecting a wearer's skull including a generally bell shaped shell of non-uniform thickness for enclosing at least an upper part of the wearer's skull, the shell having an upper crown portion with a depending circumferential wall area which has an upper wall area adjacent to the upper crown portion and a lower wall area, said lower wall area having a wall thickness generally greater than a wall thickness of said upper wall area, and a support system attached to the lower wall area of the shell, wherein in normal use the support system rests on the wearer's skull and maintains an inside surface of the shell at least a predetermined distance from the wearer's skull. Preferably the crown portion has a wall thickness generally greater than a zone of said shell between said upper crown portion and said upper wall area. Conveniently the predetermined distance is no less than 5 mm.

Preferably the aforesaid zone has a thickness less than the thickness of said upper wall area. Preferably the thickness of the shell merges smoothly between the lower wall area and the upper crown portion.

In one preferred arrangement, the upper crown portion includes a central crown area and a surrounding outer crown area with the central crown area having a thickness greater than that of the outer crown area. The aforesaid zone may be formed by the outer crown area, by a portion of the outer crown area or by a separate portion between the outer crown area and the upper wall area.

In accordance with a second aspect, the present invention provides a hat having an outer covering of a flexible sheet material, a generally bell shaped shell moulded from a high impact resistant material, the shell having an upper crown portion with a depending circumferential wall area adjacent to the upper crown portion, the shell being configured to fit within said outer covering, and a support system attached to a lower wall area of the shell, wherein in normal use, the system rests on the wearer's skull and maintains an inside surface of the shell at least a predetermined distance from the wearer's skull.

Preferred features of this aspect of the invention may be as defined in claims 20 to 25 as annexed hereto which are hereby made part of the disclosure of this specification.

According to a still further aspect, the present invention provides headgear for protecting a wearer's skull including:

a generally bell-shaped shell of non-uniform thickness for enclosing at least an upper part of the wearer's skull, the shell having a crown surrounded by a wall, the thickness of the crown being between 2.0+or −0.1 mm and 3.4+or −0.1 mm and the thickness of the wall being between 2.6+or −0.1 mm and 3.8+or −0.1 mm, and a support system attached to a lower region of the wall of the shell, wherein in normal use the support system rests on the wearer's skull and maintains an inside surface of the shell no less than 5 mm from the wearer's skull.

An advantage of the headgear of the present invention is that the construction is sufficiently compact that it can be inserted into an existing hat, thus combining a fashionable appearance with practical advantages. Alternatively the headgear may be incorporated into a new hat during manufacture.

In the event of accident the shell is the first part of the headgear to strike a solid object such as the ground or a tree, post or the like. This could happen, for example, when a rider is thrown or dismounted from a horse or falls from a bicycle. The shell must therefore protect the wearer's head against impact injury including penetration, which would cause major brain injuries and potentially prove to be fatal.

In the past, protective headgear commonly included a shell of generally constant thickness. It has now been found that a shell of non-uniform thickness is more efficient in protecting a wearer and is far more efficient at absorbing impact and shock energy than a shell of even thickness. Without wishing to be bound by theory, it is believed that the shell of the present invention absorbs part of the impact energy by elastic deformation and/or by crumpling of one or more areas, sufficient to avoid contact between the shell and the wearer's skull, but large enough to avoid deceleration injury.

The shell is of generally bell-shape that is a shape that conforms generally to the shape of the upper part of a user's skull. For example the shell may be hemispherical. Typically, the shell is of a shape that encloses virtually all of the frontal and parietal bones of the wearer's skull, and at least a part of the occipital, temporal and spheroid bones. The uppermost or crown portion of the shell is located adjacent the pre-central and post-central gyrus of the wearer's brain and thus protects the premotor, primary motor and general sensory areas of brain function.

In a preferred embodiment, the shell comprises an uppermost crown defined by a wall, the crown and wall being of non-uniform thickness. Preferably, the thickness of the crown is between 2.2+or −0.1 mm and 3.2+or −0.1 mm. Preferably, the thickness of the wall is between 2.8+or −0.1 mm and 3.6+or −0.1 mm.

The crown preferably has a central crown area defined by an outer crown area, and preferably the wall has an upper wall area, which is adjacent a lower wall area, each of the areas being of different thickness to the adjacent area(s).

Typically the central crown area is between 2.4+or −0.1 mm and 3.4+or −0.1 mm thick, preferably between 2.8+or −0.1 mm and 3.3+or −0.1 mm, more preferably between 3.1+or −0.1 mm and 3.3+or −0.1 mm. The central crown area may be of any convenient conformation. For example, the central crown area may be flat, convex or concave. In a particularly preferred embodiment, the central crown area is generally depressed relative to the surrounding outer crown area and includes a centrally located dome (outwardly convex).

Typically, the central crown area is enclosed by the outer crown area. Preferably the outer crown area is between 2.0+or −0.1 mm and 2.4+or 0.1 mm thick, preferably between 2.1+or −0.1 mm and 2.3+or −0.1 mm. In a preferred embodiment the outer crown area is raised relative to the central crown, forming a continuous ridge around the central crown area.

Typically the outer crown area is adjacent the upper wall area, and the upper wall area is preferably between 2.6+or −0.1 mm and 3.0+or −0.1 mm thick, or more preferably between 2.7+or −0.1 mm and 2.9+or −0.1 mm.

Typically the upper wall area is also adjacent a lower wall area. The lower wall area is between 3.4+or −0.1 mm and 3.8+or −0.1 mm thick, more preferably between 3.5+or −0.1 mm and 3.7+or −0.1 mm. The lower wall area will typically terminate with at an edge, or a flange forming a brim.

The shell may be of unitary construction, the thickness of the shell changing progressively from one area to another. Preferably the shell is made of highly impact-resistant material, including plastics or polymers such as polycarbonate, ABS or an alloy of these two materials. The shell may be made by any convenient method such as injection molding or press molding.

The support system in normal use maintains the inside surface of the shell no less than 5 mm from the wearer's skull. The support system may comprise strapping, webbing, netting or the like. Typically, the support system comprises a band that encircles the wearer's head at the upper forehead level plus three straps, each of which passes of the crown of the user's head, the ends being attached to the band. Typically, the band is of adjustable length so that the wearer can control the fit.

Where straps are used, typically their width is between 15 and 25 mm, preferably 25 mm for good load distribution and comfort. The straps can be made of the material used for seat belt construction, which material is known to have excellent shock absorbing characteristics.

The band may be held in place at the lower wall area of the shell by any convenient means. Preferably the band is held in place by anchorage devices, each anchorage device having a first end located in a recess in the band and a second end located correspondingly located recess in the shell. Typically, the ends can be elastically deformed to fit into the recesses. The anchorage device may perform the function of a spacer, maintaining the inside surface of the shell at least 5 mm from the wearer's skull. In a preferred embodiment, the headgear includes four anchorage devices, located adjacent and on either side of the wearer's ears.

Again, without wishing to be bound by theory, it is believe that in the case of significant impact to the shell, energy not absorbed by the shell is transmitted to the support system. Furthermore, the support system will be stretched by the impact load, absorbing the remainder of the energy by elastic or even plastic deformation, depending on the severity of the impact.

Optionally, the headgear will also incorporate a chin strap attached to the outer shell by any convenient means, such as studs on each side of the wearer's ears. The shell may be reinforced or thickened at or adjacent the attachment point, because these areas are likely to suffer stress concentration during an impact. The chin strap assists in maintaining the hat in the correct position during a front, side or rear impact. The chin strap can be equipped with a quick fastening system for easy length adjustment. The chin strap may be made of any convenient material.

Optionally, a solid impact absorber may be attached to the inside surface of the shell, preferably adjacent the central crown area of the shell. Typically, when an impact occurs, the solid impact absorber will absorb some of the impact energy by deformation. The solid impact absorber may assist in maintaining the inside surface of the shell at least 5 mm from the wearer's skull. Typically, the solid impact absorber is expanded polystyrene foam having a density between about 80 and 95 g/l, preferably 90 g/l.

Preferably there is a continuous ventilation path between the front and rear of the headgear. The 5 mm or more gap between the inside of the shell and the support system may define a suitable ventilation path. Head motion during activities such as horse riding, or bicycle riding creates an increase in air pressure in front of the rider's head and a reduction in air pressure behind the rider's head. Thus external air is forced under the leading edge of the shell, along the ventilation path and out the following edge of the shell. Vent holes in the front and back of the shell may facilitate air flow. In a further possible embodiment, a series of vent holes may be provided spaced around the periphery of the shell at an upper level of the side wall slightly below the trough level between the inner and outer crown regions of the shell. The vent openings may be spaced about by 40 to 50 mm.

Optionally, the headgear includes comfort padding, provided that the padding does not interfere with the operation of the support system. The comfort padding may optimise both comfort and fit. Typically the comfort padding is in the form of soft pads that can be attached to the inside of the hat using Velcro™.

Headgear according to the invention of the present invention can be made to conform to both Australian Standard AS 1801-1997 "Occupational Protective Helmets" and US Standard F 1163-95.

The invention will now be further described with reference to the following drawings that depict non-limiting preferred embodiments of headgear of the present invention in which.

Figure 1:
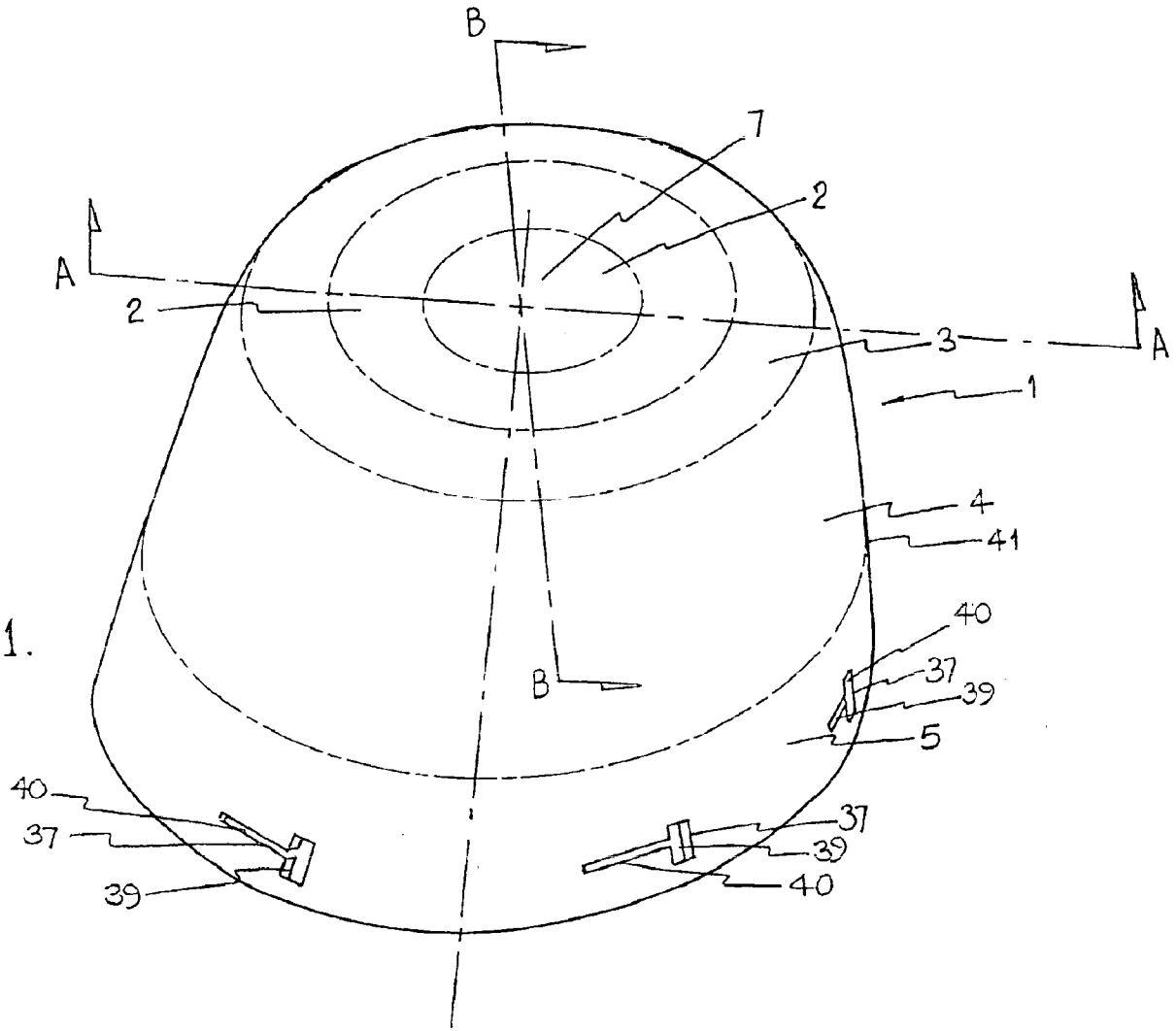
FIG. 1 is a perspective view of the shell of one embodiment of the headgear of the present invention.
Figure 1A:
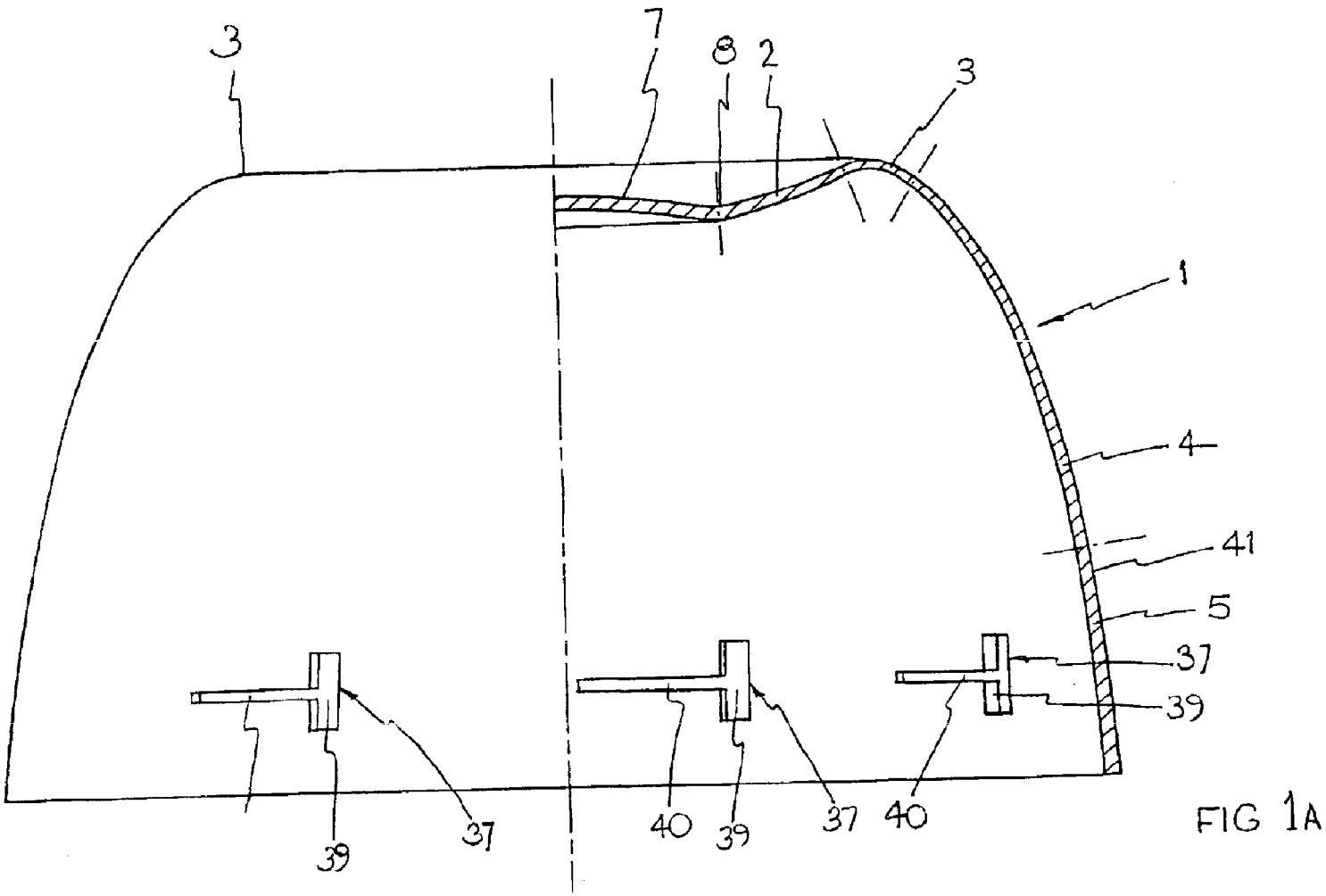
FIG. 1A is a partially longitudinal section (along line A—A of FIG. 1) side view of the shell shown in FIG. 1.
Figure 1B:
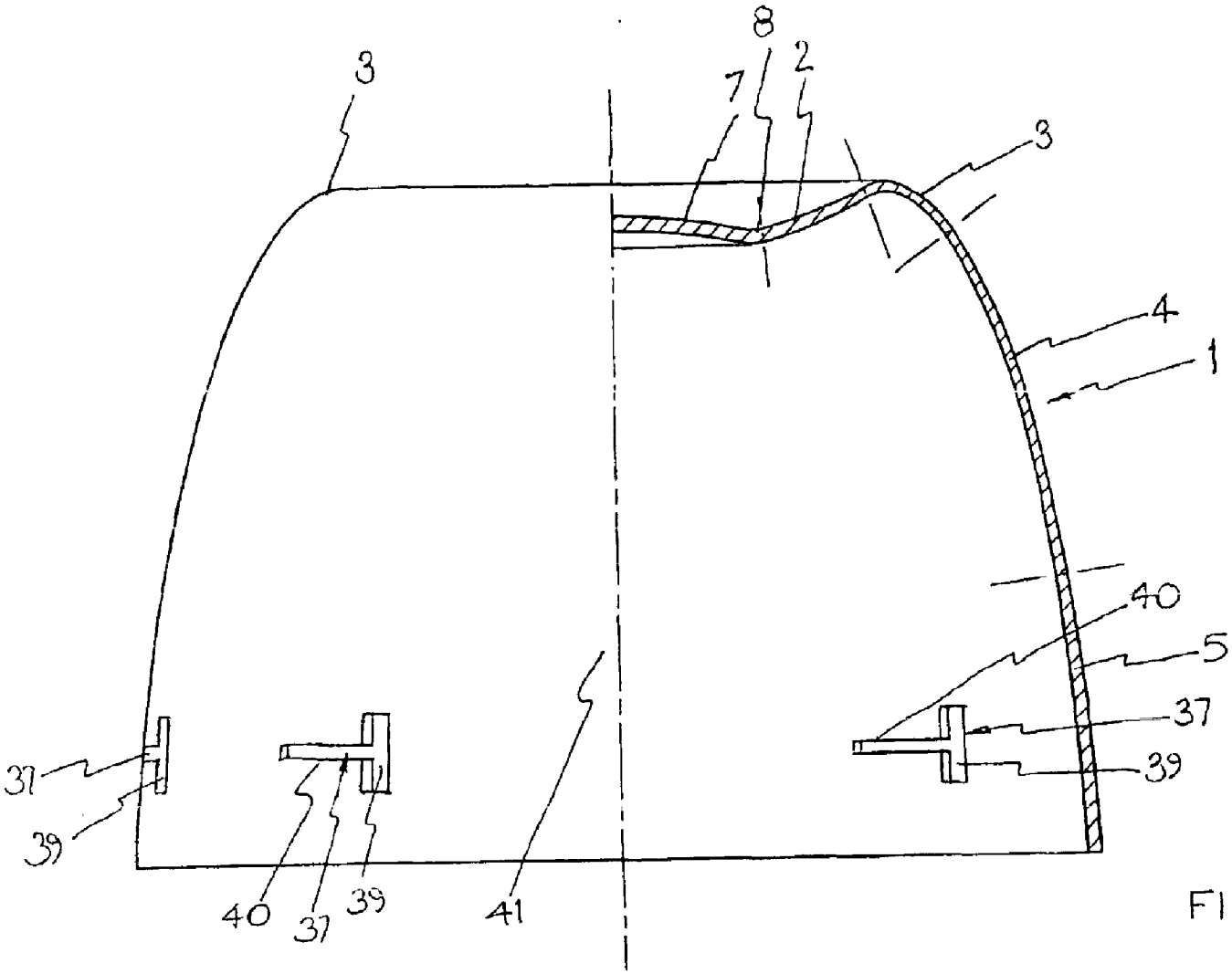
FIG. 1B is a partially transverse section (along line B—B of FIG. 1) front view of the shell shown in FIG. 1.

FIG. 1 is a perspective view of one embodiment of the shell (1) of the headgear showing four areas of different thickness. The shell is generally bell-shaped, of a size and shape that encloses virtually all of the frontal and parietal bones of a wearer's skull, and at least a part of the occipital, temporal and spheroid bones. The crown area is formed by a central crown area (2) and an outer crown area (3) which are located adjacent the pre-central and post-central gyrus of the wearer's brain.

In the illustrated embodiment, the central crown area (2) is depressed relative to the surrounding outer crown area (3) and includes a raised dome section (7) in the centre and a trough section (8) between the raised dome section (7) and the outer crown area (3). The central crown area (2) may be 3.2+/−0.1 mm thick with the surrounding outer crown area (3) in the illustrated embodiment forming a continuous ridge which may be 2.2+/−0.1 mm thick.

The shape of the crown area (2) and (3) may vary depending on the shape of the hat ultimately to be constructed. For example, the outer crown area (3) may have a greater radial width with the central crown area simply forming a depression. In other embodiments fore and aft extending spaced ridges may be formed in the crown area.

Below the crown area (2) and (3) an upper wall area (4) is provided encircling the perimeter of the outer crown. The upper wall area (4) may be 2.8+/−0.1 mm thick.

A lower wall area (5) encircles the perimeter of the upper wall and terminates at a lower edge of the shell. The lower wall area may be 3.6+/−0.1 mm thick. The lower wall area (5) may be oval in shape when viewed in plan having a major dimension of 211+/−2.0 mm in length. The minor dimension of the oval shape may have a dimension of 175+/−1.5 mm in length.

Figure 5:
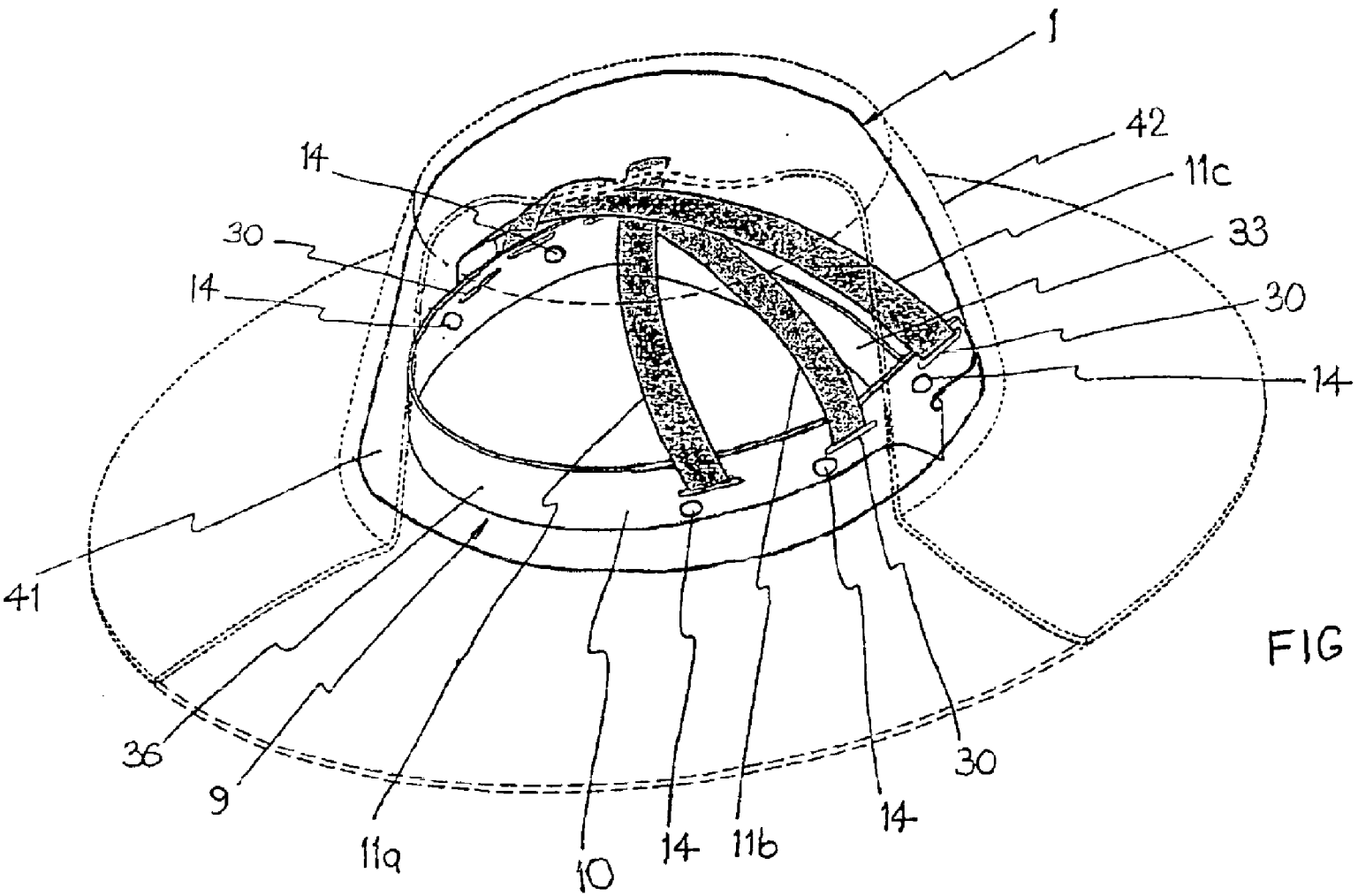
FIG. 5 shows the shell of FIG. 1, the support system including the band of FIG. 2 and the anchor device of FIG. 3 in combination to form one preferred embodiment of the headgear of the present invention.

A first embodiment of the support system (9) for the headgear is best illustrated in FIGS. 2, 2A, 3, 3A, and 5 of the accompanying drawings. The support system (9) includes an adjustable head band (10) intended to encircle the upper part of the user's skull at the level of the upper forehead, together with three (15 mm wide) straps **(11*a*, 11*b*, 11*c*) each of which passes over the crown of the user's head crossing each other as they pass over the crown. The ends of each strap (11*a*, 11*b*, 11*c*) are attached to the head band (10) by passing through slots (30) provided for this purpose. The head band (10) includes a first end (31) having guide formations (32) to receive a second end (33) of the band (10) in a slidable adjacent configuration. The first end (31) also includes a plurality of projections (34) each of which is adapted to be received in one of a plurality of apertures (35) formed in the second end (33) whereby the band (10) is adjustable in length for different head sizes. The end regions (31) and (33) are angled downwardly relative to a central region (36) of the band to provide a lower support towards the rear of the wearer's head as shown in FIG. 5**.

Figure 3A:
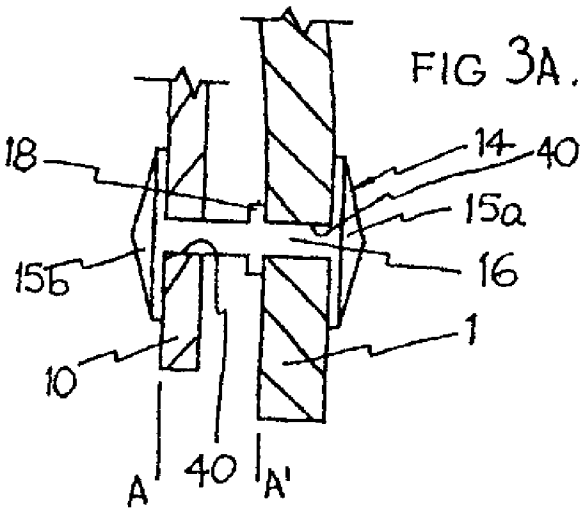
FIG. 3A is a section view showing the anchor device of FIG. 3 in a position of use.
Figure 3:
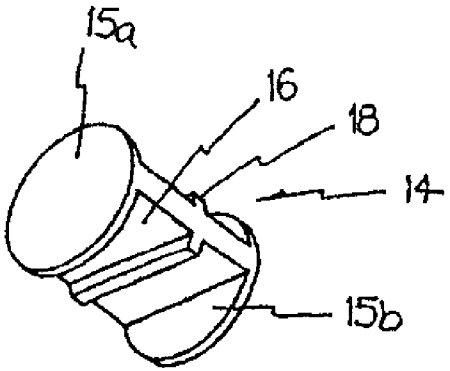
FIG. 3 is a perspective view of one embodiment of an anchor device for securing together the shell and support system of the headgear of the present invention.

FIG. 3 is a perspective view of one embodiment of an anchor device (14) for securing together the shell (1) and support system (9) of the headgear of the present invention. The anchor device (14) includes a shaft (16) having a centrally located flange (18), the ends of the shaft terminating in heads or conical shaped bosses **(15*a*, 15*b*). The shaft (16) is conveniently rectangular in cross-section having a width equal to the diameter of the heads (15*a*, 15*b*)**.

FIG. 3A depicts the anchor device (14) of FIG. 3 in use. One end of the anchorage device (15*a*) is located adjacent the shell (1) while the other end (15*b*) located adjacent the band (10) of the support device (9). Intermediate the two ends of the anchorage device is the flange (18) that maintains the relative positions of the shell (16) and the band (10) such that the distance A–A' is preferably never less than 5 mm. That is, the anchorage device (14) performs the additional function of a spacer, maintaining the inside surface of the shell at least 5 mm from the wearer's skull.

The anchor devices (14) are conveniently secured to the shell (1) and the head band (10) by engagement with suitably positioned key hole apertures (37) provided in the shell (1) and (38) in the band (10). Each of the keyhole apertures has a larger opening (39) through which the head regions (15*a*, 15*b*) may pass and a narrower slot region (40) engagable with the shaft regions (16) of the anchor devices (14) in use. Conveniently in the shell (1), the larger openings (39) on both sides of the shell face towards a forward end (41) of the shell.

Figure 2:
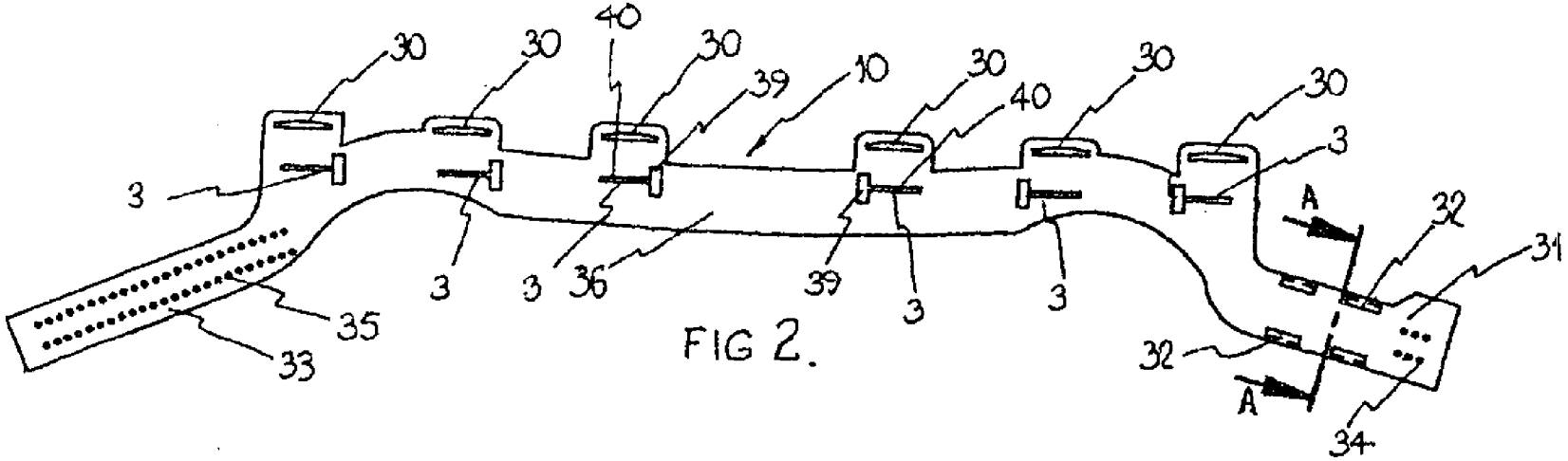
FIG. 2 is a plan view of an adjustable head engaging band used in a support system for headgear according to this invention.
Figure 2A:
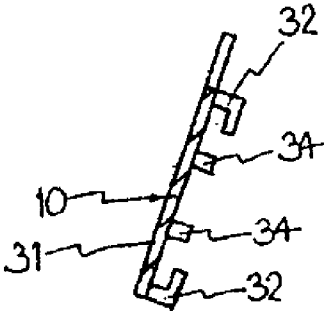
FIG. 2A is a sectional view along line A—A of FIG. 2.
Figure 4:
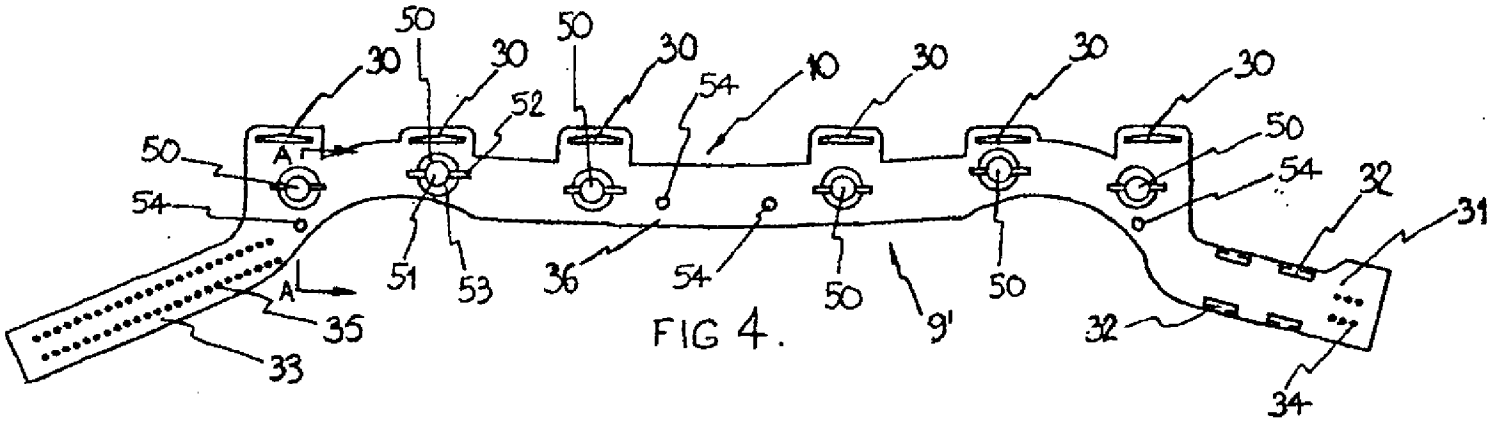
FIG. 4 is a plan view of an adjustable head engaging band similar to FIG. 2, but showing an alternative means of connecting the shell thereto.
Figure 4A:
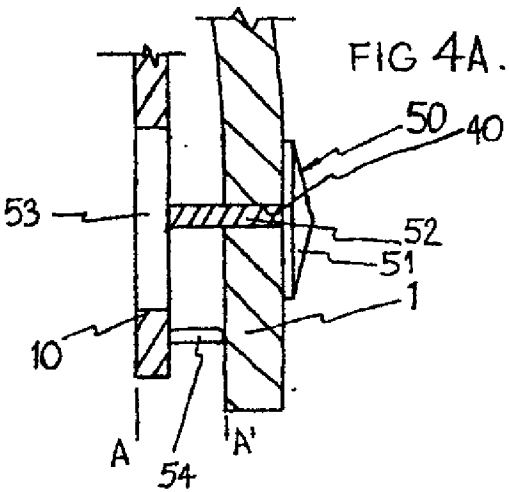
FIG. 4A is a section view along line A—A of FIG. 4.

Referring now to FIGS. 4 and 4A, a modified support device (9') is shown including an adjustable head band (10) similar to that which is shown in FIG. 2. Like features have been give the same reference numerals and are therefore not further described hereinafter. In this modified support device (9') anchor devices (50) are provided but which are integrally moulded with the head band (10) rather than being separate therefrom. The anchor devices (50) include a circular disc or head (51) supported on a web (52) that spans a circular opening (53) in the head band (10). The web (52) is integrally formed with the band (10) on opposed sides of the opening (53). The circular disc or head (51) engages with the keyhole openings (37) in the shell (1) in the same way as the heads (15*a*) of the separate anchor devices (14) of FIG. 2. The minimum spacing A–A' between the wearer's skull and the inside surface of the shell (1) is maintained by a plurality of spaced projections (54) also integrally formed with the band (10). This minimum distance is desirably at least 5 mm.

FIG. 5 illustrates schematically the shell (1) of FIG. 1, the support system (9) including a plurality of anchor devices (14) or (50) in combination to form one preferred embodiment of headgear of the present invention. The headgear may be covered by a cover (42) in the style of a wide brimmed hat or in fact any other style. Conveniently the shape of the crown region of the shell (1) approximates the shape of the crown of the hat cover (42).

Figure 6C:
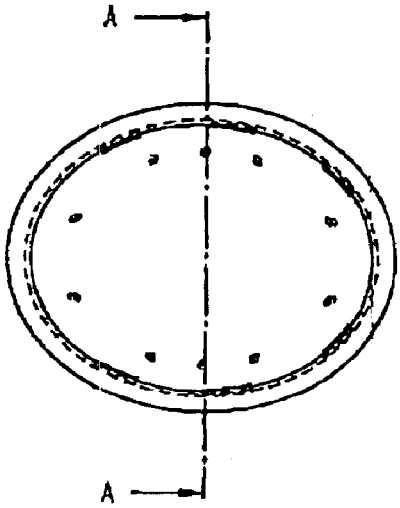
FIG. 6C is a top view of the shell of FIG. 6A.
Figure 6D:
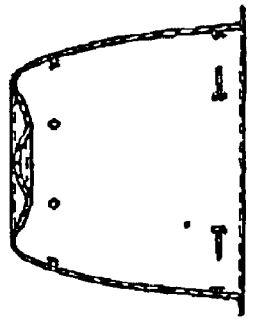
FIG. 6D is a transverse section (along line A—A of FIG. 6C) front view of the shell of FIG. 6A.
Figure 6A:
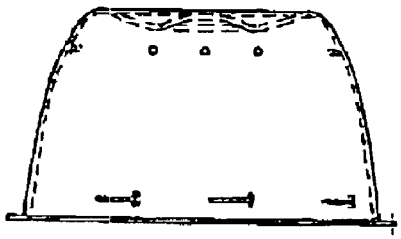
FIG. 6A is a side view of the shell of another embodiment of the headgear of the present invention with the inner features of the shell shown dotted in "ghost form"
Figure 6B:
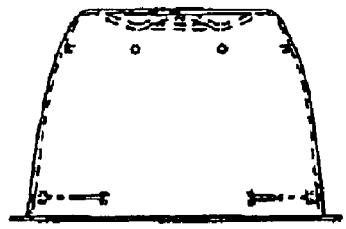
FIG. 6B is a front view of the shell of FIG. 6A

FIGS. 6A to 6C illustrate a variation of the shell of FIG. 1 to which a 10 mm flange has been added around the base of the shell. The flange serves to increase the stiffness of the shell. A second, minor, variation is the elevation of the raised dome of the central crown area to approximately the same height as the outer crown area.

Experimental

The shell depicted in FIG. 1 was tested using computer simulation for compliance under three separate testing regimes. A comparative example was also tested, the comparative example comprising a shell of uniform thickness of 2.8 mm, and having a simple depression in the crown (but no dome as per the headgear of FIG. 1). For the purposes of the simulation the shell of FIG. 1 and the comparative example were deemed to be manufactured from CYCOLOY C1200 polymer. (CYCOLOY C1200 is a trade mark of General Electric Corp.)

The comparative example was modeled in IGES file format and the headgear of FIG. 1 was created as a full thickness, full revolution model by modification within Rhino and Solid Edge V8 software by Leap Australia Pty Ltd. For the purpose of finite element analysis, the IGES file and later files based on it were imported into ANSYS and a finite element mesh was generated from them.

Test 1

The shell of FIG. 1 and the comparative example were tested according to the "Resistance to Penetration" regime of Australian Standard 1801-1997, Clause 4.6. This regime requires that a 3 kg pointed striker with 60 degree included angle and 0.5 mm tip radius is dropped from 1 metre to impact on the shell being tested within 50 mm of the top or centre of the crown. The minimum safety requirement is that the striker under this free fall should not hit a head form located in the headgear to simulate a human head.

The shell was constrained at four points around its edge to simulate the support system attachment that connects the support system to the head form. Nodes in these regions were fully constrained in all degrees of freedom. For the analysis, the striker geometry was created as per the specifications and modeled as a rigid body.

Both the comparative example and the helmet of FIG. 1 satisfied the requirements of AS 1801-1997. However, the penetration depth of the striker into the shell of the present invention was far less that the penetration depth into the comparative example.

Test 2

The shell of FIG. 1 and the comparative example were tested according to the "Shock Absorption Test" of Australian Standard 1801-1997, Clause 4.6. In this test a 5 kg, 50 mm spherical striker is allowed to fall freely onto the shell with energy of 50 J. The minimum safety requirement is that the deceleration of the striker must not exceed 980 $m/s^2$ and the force transmitted to a head form located in the shell must not exceed 5 kn.

The shells being tested were constrained at four points around their edge to simulate the support system attachment that connects the support system to the head form. Nodes in these regions were fully constrained in all degrees of freedom.

The comparative example did not comply with AS 1801-1997; that is, the deceleration of the striker exceeded 980 $m/s^2$ indicating insufficient shock absorption.

By comparison, the shell of FIG. 1 satisfied the requirement of AS 1801-1997 with a maximum deceleration of the striker of approximately 815 m/s 2 which is less than the maximum value of 980 $m/s^2$ required by the standard. It is believed that when the striker contacts the shell, energy is absorbed by the shell due to collapse of the raised dome in the central crown area, and "crumpling" of the outer crown area.

Test 3

The shell of FIG. 1 and the comparative example were tested according to the "Stiffness Test" of Australian Standard 1801-1997, Clause 4.5. In this test a 90 N compressive load is applied to the shell. The safety requirement is that the shell does not deform more than 15 mm measured 8 to 10 seconds after the load is applied.

For the Stiffness Test, the shell was fixed on one side to simulate the loading face of the compression-testing machine defined in AS 1801-1997. A load was then applied to an identically sized area on the opposite face of the helmet to simulate compressive loading.

The comparative example did not meet the requirements of AS 1801-1997. Under compressive loading for the stiffness test, the comparative example was too flexible and deformed inwardly beyond the acceptable 15 mm limit.

By comparison, the shell of FIG. 1 satisfied the requirement of AS 1801-1997 with deformation of less than the 15 mm limit required by the standard. It is believed that the thickness of the lower wall region contributed to the better performance.

While the foregoing describes preferred embodiments of the invention, various modification scan be included without departing from the spirit and scope of the invention.

What is claimed is:

1. Headgear for protecting a wearer's skull including:

a generally bell-shaped shell of non-uniform thickness for enclosing at least an upper part of the wearer's skull, the shell having a crown surrounded by a wall, wherein the crown has a central crown area surrounded by an outer crown area, and the wall has an upper wall area, which is adjacent a lower wall area, each of the areas being of different thickness to the adjacent area(s); and a support system attached to a lower region of the wall of the shell, wherein in normal use the support system rests on the wearer's skull and maintains an inside surface of the shell at least a predetermined distance from the wearer's skull.

2. Headgear according to claim 1 wherein the central crown area is between 2.4 +or −0.1 mm and 3.4 +or −0.1 mm, the outer crown area is between 2.0 +or −0.1 mm and 2.4 +or −0.1 mm thick, the upper wall area is between 2.6 +or −0.1 mm and 3.0 +or −0.1 mm thick and the lower wall area is between 3.4 +or −0.1 mm and 3.8 +or −0.1 mm thick.

3. Headgear according to claim 1 wherein both the central crown area and the outer crown area have outward convex surfaces separated by a trough region.

4. Headgear according to claim 3 wherein the outer crown area has a maximum height greater than the maximum height of the central crown area.

5. A hat including the headgear of claim 1 wherein the shell is enclosed within felt, cloth, leather or other material.

6. Headgear for protecting a wearer's skull including a generally bellshaped shell of non-uniform thickness for enclosing at least an upper part of the wearer's skull, the shell having an upper crown portion having a central crown area and a surrounding outer crown area, the shell further having a depending circumferential wall which has an upper wall area adjacent to the outer crown area and a lower wall area, said lower wall area having a wall thickness generally greater than the wall thickness of said upper wall area and said central crown area having a wall thickness generally greater than the wall thickness of said outer crown area, and a support system attached to the lower wall area of the shell, wherein in normal use the support system rests on the wearer's skull and maintains an inside surface of the shell at least a predetermined distance from the wearer's skull.

7. Headgear according to claim 6 wherein the predetermined distance is no less than 5 mm.

8. Headgear according to claim 6 wherein the upper wall area has a thickness greater than the thickness of the outer crown area.

9. Headgear according to claim 6 wherein the central crown area is generally depressed relative to the surrounding outer crown area and includes a centrally located dome, the outer crown area forming a continuous ridge around the central crown area.

10. Headgear according to claim 6 wherein the upper crown portion has a thickness varying from 2.0 +or −0.1 mm to 3.4 +or −0.1 mm and the thickness of the circumferential wall varying from 2.6 +or −0.1 mm to 3.8+or−0.1 mm.

11. Headgear according to claim 6 wherein the central crown area is between 2.4 +or −0.1 mm and 3.4 +or −0.1 mm, the outer crown area is between 2.0 +or −0.1 mm and 2.4 +or −0.1 mm thick, the upper wall area is between 2.6 +or −0.1 mm and 3.0 +or −0.1 mm thick and the lower wall area is between 3.4 +or −0.1 mm and 3.8 +or −0.1 mm thick.

12. A hat including the headgear of claim 6 wherein the shell is enclosed within felt, cloth, leather or other material.

13. Headgear for protecting a wearer's skull including:

a generally bell shaped shell of non-uniform thickness for enclosing at least an upper part of the wearer's skull, the shell having an upper crown portion with a depending circumferential wall area which has an upper wall area adjacent to the upper crown portion and a lower wall area, said crown portion having a wall thickness generally greater than a zone of said shell between said upper crown portion and said upper wall area, said lower wall area having a wall thickness generally greater than a wall thickness of said upper wall area, and a support system attached to the lower wall area of the shell, wherein in normal use the support system rests on the wearer's skull and maintains an inside surface of the shell at least a predetermined distance from the wearer's skull.

14. A hat including the headgear of claim 13 wherein the shell is enclosed within felt, cloth, leather or other material.

15. Headgear according to claim 13 wherein the predetermined distance is no less than 5 mm.

16. Headgear according to claim 13 wherein said zone has a thickness less than the thickness of said upper wall area.

17. Headgear according to claim 13 wherein the thickness of said shell merges smoothly between the lower wall area and the upper crown portion.

18. A hat having an outer covering of a flexible sheet material, a generally bell shaped shell of non-uniform thickness moulded from a high impact resistant material, the shell having an upper crown portion with a depending circumferential wall area adjacent to the upper crown portion, the upper crown portion having a wall thickness generally greater than a zone of the shell between the upper crown portion and the depending circumferential wall area, the shell being configured to fit within said outer covering, and a support system attached to a lower wall area of the shell, wherein in normal use, the system rests on the wearer's skull and maintains an inside surface of the shell at least a predetermined distance from the wearer's skull.

19. A hat according to claim 18 wherein the depending circumferential wall area is formed by a first upper wall area and a second lower wall area, the second lower wall area having a thickness greater than said first upper wall area.

20. A hat according to claim 18 wherein said zone has a thickness less than the thickness of said depending circumferential wall area.

21. A hat according to claim 18 wherein the predetermined distance is no less than 5 mm.

22. A hat according to claim 18 wherein the outer covering includes a shell covering portion and a wide surrounding brim formed at lower edge of said shell covering portion.

* * * * *